US006641968B2

(12) United States Patent
Uchida

(10) Patent No.: US 6,641,968 B2
(45) Date of Patent: Nov. 4, 2003

(54) ELECTROPHOTOSENSITIVE MATERIAL, PRODUCTION METHOD OF THE SAME AND METHOD FOR INSPECTING AN INTERMEDIARY OF THE SAME

(75) Inventor: Maki Uchida, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 10/102,728

(22) Filed: Mar. 22, 2002

(65) Prior Publication Data

US 2003/0039907 A1 Feb. 27, 2003

(30) Foreign Application Priority Data

Mar. 23, 2001 (JP) ..... 2001-083925

(51) Int. Cl.[7] ..... G03G 5/14
(52) U.S. Cl. ..... 430/131; 430/60
(58) Field of Search ..... 430/60, 131, 100, 430/62; 399/130

(56) References Cited

U.S. PATENT DOCUMENTS 5,279,914 A * 1/1994 Aizawa et al. ..... 430/59
6,355,390 B1 * 3/2002 Yamanami et al. ..... 430/60
2002/0076634 A1 * 6/2002 Uchida ..... 430/60

FOREIGN PATENT DOCUMENTS

JP 5-19518 1/1993

* cited by examiner

*Primary Examiner*—John Goodrow
(74) *Attorney, Agent, or Firm*—Smith, Gambrell & Russell, LLP

(57) ABSTRACT

The invention relates to an electrophotosensitive material comprising an intermediate layer formed between a conductive substrate and a photosensitive layer, and featuring heat treatment conditions for forming the intermediate layer defined such that a ratio $A_2/A_1$ between absorbances at two measurement wavelengths determined from a visible absorption spectrum of the intermediate layer is not more than a value of an intersection of a first approximation line and a second approximation line given by a correlation distribution between the absorbance ratio and the residual potential of the photosensitive material, the first approximation line representing little change of the residual potential despite the increase of the ratio $A_2/A_1$, the second approximation line representing a proportional increase of the residual potential with increase of the ratio $A_2/A_1$. The invention provides the electrophotosensitive material free from the variations of residual potential.

3 Claims, 8 Drawing Sheets

ELECTROPHOTOSENSITIVE MATERIAL, PRODUCTION METHOD OF THE SAME AND METHOD FOR INSPECTING AN INTERMEDIARY OF THE SAME

TECHNICAL FIELD

The present invention relates to an electrophotosensitive material comprising an intermediate layer (undercoat layer) formed between a conductive substrate and a photosensitive layer.

BACKGROUND OF THE INVENTION

As an electrophotosensitive material for use in image forming apparatuses such as electrostatic copiers, plain paper facsimiles, laser beam printers and combined devices having these functions, a so-called organic electrophotosensitive material is widespread which comprises a combination of the following components:

- a charge generating material for generating electric charges (positive hole and electron) when exposed to light;
- a charge transport material for transporting the generated electric charges; and
- a binder resin.

The charge transport materials fall into two broad categories which include a hole transport material for transporting positive holes of the electric charges, and an electron transport material for transporting electrons.

The organic electrophotosensitive material has an advantage over an inorganic electrophotosensitive material employing an inorganic semiconductor material in that the organic electrophotosensitive material is fabricated more easily at less production costs than the latter.

In addition, the organic electrophotosensitive material also has a merit of greater freedom of function design by virtue of a wide variety of options for materials including those described above.

In this connection, the organic electrophotosensitive materials have recently been widely used in the image forming apparatuses.

The organic electrophotosensitive material is fabricated by forming either of the following photosensitive layers on a conductive substrate:

- A single-layer photosensitive layer containing a charge generating material, charge transport material (hole transport material and/or electron transport material) and binder resin; and
- A multi-layer photosensitive layer in which a charge generating layer containing a charge generating material, and a charge transport layer containing a charge transport material (hole transport material and/or electron transport material) are laminated in this order or vise versa.

Unfortunately, these photosensitive layers encounter the following problems when formed directly on the conductive substrate.

(a) In a charging step of the image formation, when a surface of the photosensitive layer is positively or negatively charged, a charge of the opposite polarity to the above occurs in the conductive substrate.

The photosensitive layer formed directly on the conductive substrate, however, is susceptible to the injection of the electric charge of the opposite polarity from the conductive substrate. If a large quantity of electric charge of the opposite polarity are injected into the photosensitive layer, the total amount of electric charge at the photosensitive layer surface is lowered.

Accordingly, an electrostatic latent image formed on the photosensitive layer surface in the light exposure step has a decreased potential difference between a light exposure region and a non-exposure region. This causes a printed image to sustain fogging due to the adhesion of toner particles to white areas thereof.

(b) The single-layer photosensitive layer or the lower layer of the multi-layer photosensitive layer is formed by applying a coating solution containing the above components onto the conductive substrate, followed by drying the coating film. In some cases, however, the resultant layer may be insufficiently bound onto the conductive substrate depending upon the type of the binder resin or the solution application conditions. This results in the delamination of the formed layer.

(c) If a surface of the conductive substrate contains a defect such as mars, the surface of the photosensitive layer formed directly on the conductive substrate will also sustain a similar defect. This defect causes black spots or white spots in the formed image. Whether the defect results in the black spots or the white spots depends upon whether the image forming process adopts the normal development method or the reversal development method.

With an aim at solving these problems, there has been proposed an electrophotosensitive material wherein an intermediate layer containing a binder resin is formed on a conductive substrate, and then a photosensitive layer is laid thereover.

By virtue of the intermediate layer so provided, this electrophotosensitive material is adapted to prevent the electric charge of the conductive substrate from being injected into the photosensitive layer, to achieve a firm bond between the conductive substrate and the photosensitive layer, and to cover up the defect in the surface of the conductive substrate for a smooth, defect-free surface of the photosensitive layer.

A thermosetting resin is preferably used as the binder resin for forming an intermediate layer having good thermal, chemical, physical and mechanical stabilities, especially insolubility in the dispersion medium (ex. organic solvent) contained in the coating solution for the photosensitive layer, and an excellent binding with the conductive substrate.

The intermediate layer containing the thermosetting resin is formed by applying a coating solution, such as prepared by dissolving or dispersing the thermosetting resin in a dispersion medium, to the surface of the conductive substrate and then heat treating the coating film for curing the thermosetting resin.

However, if the heat treatment is insufficient, the curing degree of the thermosetting resin is lowered so that the intermediate layer is decreased in the thermal, chemical, physical and mechanical stabilities. When a coating solution for photosensitive layer is applied to such an intermediate layer in order to overlay the photosensitive layer thereon, the intermediate layer will be dissolved or changed in properties by a dispersion medium contained in the coating solution. This may result in nonuniform thicknesses or inhomogeneous compositions of the photosensitive layer.

With a low curing degree of the thermosetting resin, the intermediate layer tends to be decreased in conductivity, leading to the likelihood of fog.

In the light exposure step of the image formation, the charge generating material generates both the positive and negative charges in the light exposure region of the photosensitive layer. One of the charges is transported to the conductive substrate while the other charge negates a charge potential of the surface of the photosensitive layer so that an electrostatic latent image is formed on the surface of the electrophotosensitive material in correspondence to a light exposure pattern.

However, if the intermediate layer between the photosensitive layer and the conductive substrate has a low conductivity, the charge (of the same polarity as that of the surface of the electrophotosensitive material) to be transported to the conductive substrate is blocked by the intermediate layer, thus remaining in the photosensitive layer.

Therefore, the electrophotosensitive material is increased in residual potential so that the printed image tends to sustain fog in its white area.

Furthermore, the intermediate layer is associated with another cause of fog. That is, a de-electrification step subsequent to an image transfer step cannot sufficiently eliminate the charge of the surface of the photosensitive layer because of the interference of the intermediate layer so that the photosensitive layer is increased in residual potential.

The present inventors have studied an approach wherein prior to the formation of the photosensitive layer, the curing degree of the thermosetting resin forming the intermediate layer is non-destructively determined so as to preclude any intermediate layer containing the thermosetting resin insufficiently cured. Then, the photosensitive layer may be laid only over an intermediate layer containing the thermosetting resin sufficiently cured.

Japanese Laid-open Patent Publication No. JP05-19518A (1993) discloses a method which comprises the steps of: applying a coating solution for surface layer on a photosensitive layer, the coating solution containing a polyester resin, an epoxy resin reactive with the polyester resin, and a photo polymerization initiator; irradiating the coating film with an actinic radiation for initiating the polymerization; and quantitatively determining the curing degree of the epoxy resin when the polymerization reaction is completed by heat aging thereby to form the surface layer.

In an infrared absorption spectrum, an absorption peak of a carbonyl group originating in the polyester resin is in a nearly saturated state. Therefore, a residual epoxy group in the epoxy resin is determined for relative absorption intensity at absorption peak based on the absorption peak of the carbonyl group, thereby to quantitize the curing degree of the epoxy resin.

However, the application of the above method is limited to the above composition, which is suitable to form the surface layer but not suitable to form the intermediate layer which is required of the aforesaid various characteristics. Hence, there has been a need for developing a novel method of determining the curing degree of the thermosetting resin contained in the intermediate layer.

SUMMARY OF THE INVENTION

It is an object of the invention to provide an electrophotosensitive material adapted to achieve a low residual potential of a photosensitive layer for offering fog-free favorable images because an intermediate layer contains a sufficiently cured thermosetting resin as a constituent thereby achieving good thermal, chemical, physical and mechanical stabilities, and also has a suitable conductivity.

Another object of the invention is to provide a method for producing the above electrophotosensitive material having favorable characteristics in high yield.

Still another object of the invention is to provide an inspection method in which measurement is taken on an intermediary before forming the photosensitive layer on the intermediate layer of an electrophotosensitive material for determining the curing degree of a thermosetting resin forming the intermediate layer, thereby classifying the intermediary into an acceptable one having a high curing degree and a defective one having a low curing degree.

In the pursuit of the above objects, the present inventors have examined a factor having a correlation with the curing degree of the thermosetting resin and permitting the non-destructive measurement thereof. And, the present inventors studied an approach to define an optimum range of the curing degree of the thermosetting resin based on the correlation between the factor and the residual potential of the electrophotosensitive material.

As a result, the inventors have found that a ratio $A_2/A_1$ between absorbances at a first measurement wavelength $W_1$ and a second measurement wavelength $W_2$ ($A_1$ denoting an absorbance at the first measurement wavelength $W_1$, $A_2$ denoting an absorbance at the second measurement wavelength $W_2$) is effective as the above factor. The first measurement wavelength $W_1$ is defined as a predetermined wavelength on a shorter-wave side of a maximum absorption wavelength in a visible absorption spectrum of the intermediate layer, whereas the second measurement wavelength $W_2$ is defined as a predetermined wavelength on a longer-wave side of the maximum absorption wavelength in the spectrum.

It is known that the thermosetting resin, in general, is gradually changed in color as the curing thereof proceeds. Thus the inventors have found that the curing degree of the thermosetting resin can be non-destructively determined by determining the ratio $A_2/A_1$ from the change of the color of the resin.

They further examined the correlation between the ratio $A_2/A_1$ and the residual potential of the electrophotosensitive material to find that these factors present a correlation distribution as shown in FIG. 1, for example.

Specifically, a electrophotosensitive material belonging to a region representing a greater ratio $A_2/A_1$ and a lower curing degree of the thermosetting resin (the right-hand region in the figure) tends to be increased in residual potential in proportion to the decrease of the curing degree, as indicated by the dots in the figure. Such a electrophotosensitive material is more likely to produce fog. Furthermore because of the low curing degree of the thermosetting resin, the electrophotosensitive material belonging to this region has poor thermal, chemical, physical and mechanical stabilities of the intermediate layer.

On the other hand, the ratio $A_2/A_1$ is not more than a value corresponding to an intersection X of:

a first approximation line representative of a portion where the increase of the ratio $A_2/A_1$ involves little change of the residual potential (a first approximation line) and a second approximation line representative of a portion where the increase of the ratio $A_2/A_1$ involves a proportional increase of the residual potential, then the residual potential of the electrophotosensitive material varies little, staying at low stable values along the first approximation line. Thus, the electrophotosensitive material is less prone to produce fog. The intermediate layer in this state has such a high curing degree of the thermosetting resin as to achieve good thermal, chemical physical and mechanical stabilities.

Thus, an electrophotosensitive material according to the invention comprises a conductive substrate, an intermediate layer containing a thermosetting resin, and a photosensitive layer, the intermediate layer and the photosensitive layer laminated on the conductive substrate in this order, wherein the intermediate layer has an absorbance ratio $A_2/A_1$ presenting a correlation distribution with respect to a residual potential of the photosensitive material, the absorbance $A_1$ measured at a first measurement wavelength $W_1$ which is a predetermined wavelength on a shorter-wave side of a maximum absorption wavelength in a visible absorption spectrum of the intermediate layer, the absorbance $A_2$ measured at a second measurement wavelength $W_2$ which is a predetermined wavelength on a longer-wave side of the maximum absorption wavelength, and in the correlation distribution, the ratio $A_2/A_1$ is not more than a value corresponding to an intersection of:

a first approximation line representative of a portion where the increase of the ratio $A_2/A_1$ involves little change of the residual potential; and a second approximation line representative of a portion where the increase of the ratio $A_2/A_1$ involves a proportional increase of the residual potential.

According to the invention, the thermosetting resin forming the intermediate layer is sufficiently cured, as described above, so that the intermediate layer features not only good thermal, chemical, physical and mechanical stabilities but also a suitable conductivity. Accordingly, the electrophotosensitive material is adapted to achieve a low residual potential of the photosensitive layer for offering fog-free favorable images.

According to the invention, a production method for the above electrophotosensitive material comprises the steps of:

previously deriving the correlation distribution between the ratio $A_2/A_1$ of the intermediate layer and the residual potential of the photosensitive material from a plurality of heat treatment conditions for curing the thermosetting resin during the formation of the intermediate layer;

forming the intermediate layer containing the thermosetting resin on the conductive substrate; and overlaying the photosensitive layer selectively on the formed intermediate layer when the ratio $A_2/A_1$ determined from a visible absorption spectrum of the intermediate layer is not more than the value corresponding to the intersection of the first and the second approximation lines in the correlation distribution.

The production method of the invention allows for the determination of the curing degree of the thermosetting resin forming the intermediate layer, before the photosensitive layer is laid thereover. This prevents a defective product having an insufficient curing degree from being committed to the subsequent step. As a result, the electrophotosensitive material having good characteristics can be produced in high yield.

According to the invention, a production method for the above electrophotosensitive material comprises the steps of:

previously deriving the correlation distribution between the ratio $A_2/A_1$ of the intermediate layer and the residual potential of the photosensitive material from a plurality of heat treatment conditions for curing the thermosetting resin during the formation of the intermediate layer;

determining from the correlation distribution the heat treatment conditions that provide the ratio $A_2/A_1$ of not more than the value corresponding to the intersection of the first and the second approximation lines;

forming the intermediate layer by curing the thermosetting resin under the heat treatment conditions thus determined; and overlaying the photosensitive layer on the intermediate layer.

The production method of the invention eliminates the possibility of producing the intermediate layer having the low curing degree of the thermosetting resin. As a result, the electrophotosensitive material having good characteristics can be produced in high yield.

According to the invention, a method for inspecting an intermediary before forming the photosensitive layer on the intermediate layer of the electrophotosensitive material according to claim 1 comprising the steps of:

previously deriving the correlation distribution between the ratio $A_2/A_1$ of the intermediate layer and the residual potential of the photosensitive material from a plurality of heat treatment conditions for curing the thermosetting resin during the formation of the intermediate layer;

measuring a visible absorption spectrum of the intermediate layer; and classifying the intermediary into an acceptable one in which the ratio $A_2/A_1$ is not more than the value corresponding to the intersection of the first and the second approximation lines, and a defective one in which the ratio $A_2/A_1$ is more than the value corresponding to the intersection.

According to the inspection method of the invention, the intermediary of the electrophotosensitive material can be classified into an acceptable one having a high curing degree of the thermosetting resin and a defective one having a low curing degree of the resin by determining the curing degree of the thermosetting resin forming the intermediate layer.

Figure 6:
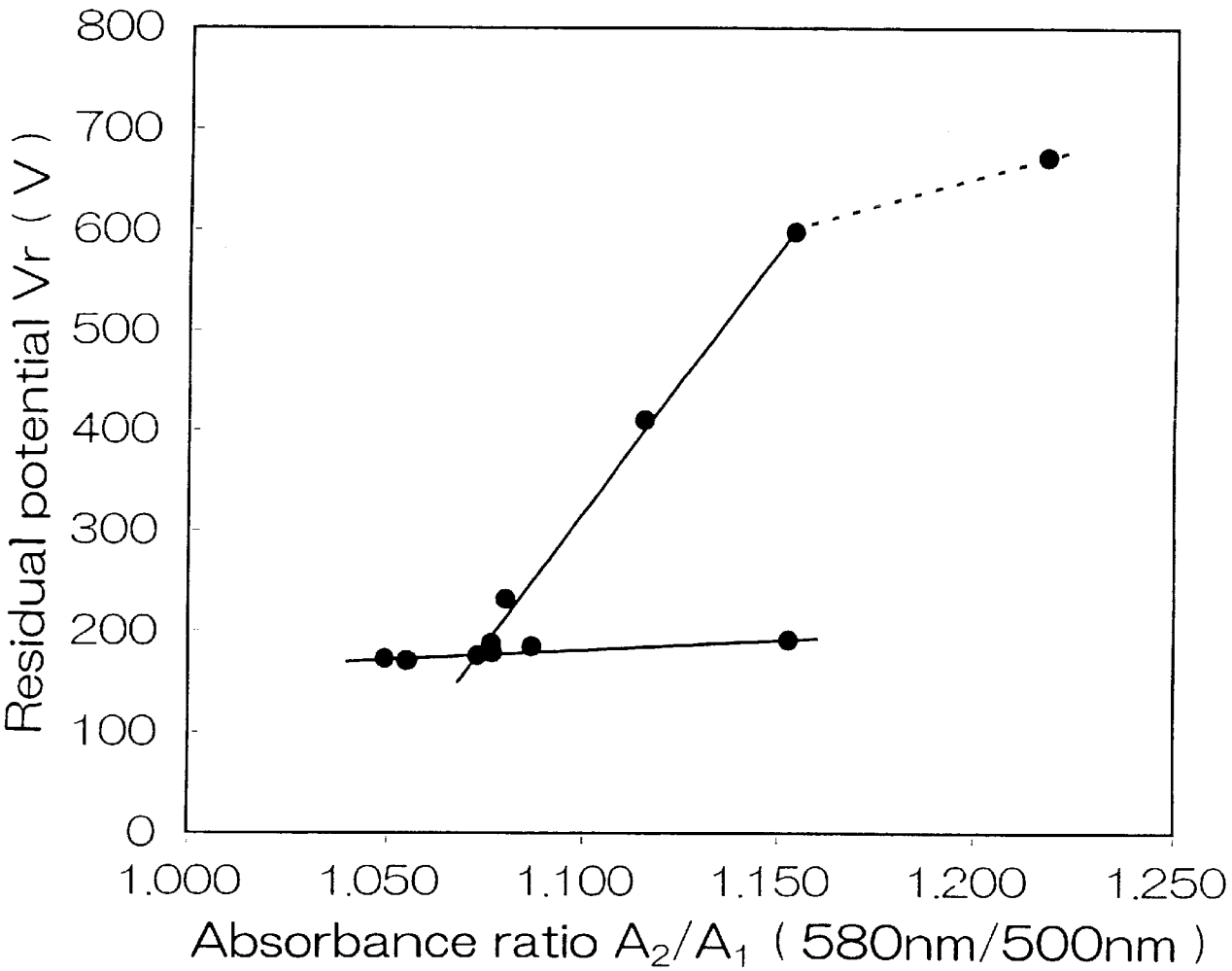
Figure 7:
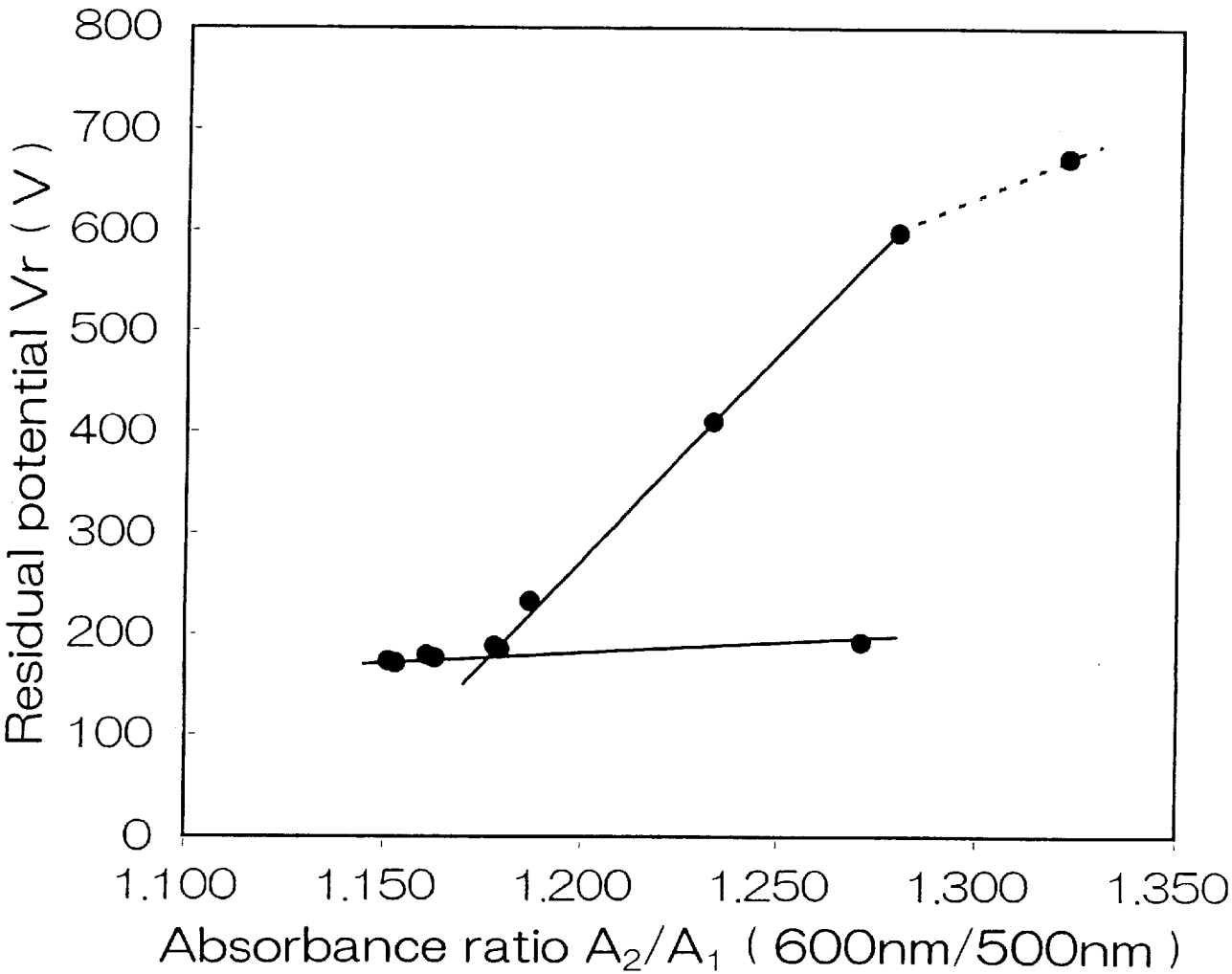
Figure 8:
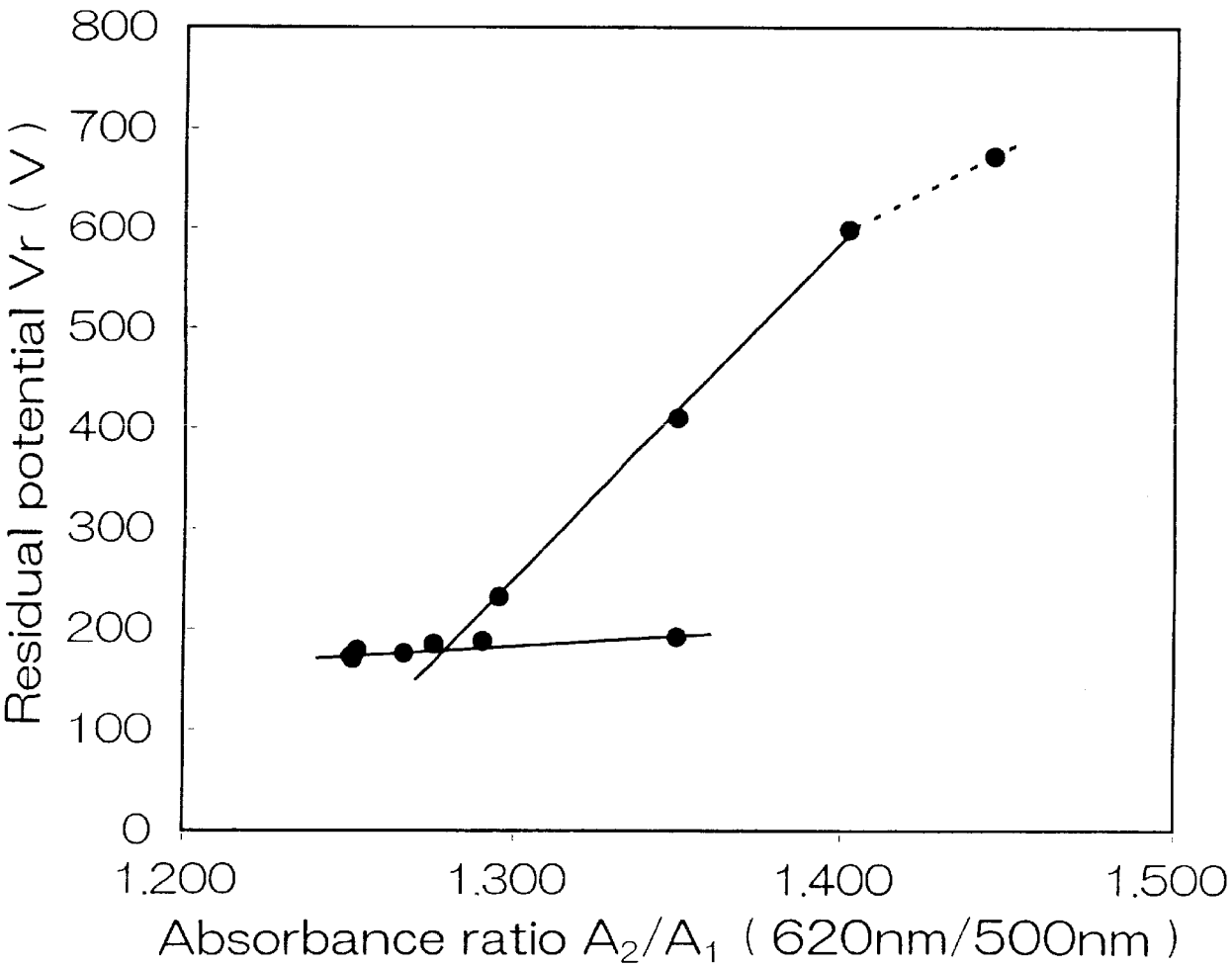

FIG. 6 is a graph showing a correlation distribution between a ratio $A_2/A_1$ and a residual potential of a electrophotosensitive material, $A_1$ denoting an absorbance at the first measurement wavelength (=500 nm) and $A_2$ denoting an absorbance at the second measurement wavelength (=580 nm) in a visible absorption spectrum of an intermediate layer of Example 2 of the invention;

FIG. 7 is a graph showing a correlation distribution between a ratio $A_2/A_1$ and a residual potential of a electrophotosensitive material, $A_1$ denoting an absorbance at the first measurement wavelength (=500 nm) and $A_2$ denoting an absorbance at the second measurement wavelength (=600 nm) in a visible absorption spectrum of an intermediate layer of Example 2 of the invention; and FIG. 8 is a graph showing a correlation distribution between a ratio $A_2/A_1$ and a residual potential of a electrophotosensitive material, $A_1$ denoting an absorbance at the first measurement wavelength (=500 nm) and $A_2$ denoting an absorbance at the second measurement wavelength (=620 nm) in a visible absorption spectrum of an intermediate layer of Example 2 of the invention.

DETAILED DESCRIPTION OF THE INVENTION

The invention will be described as below.

Electrophotosensitive Material

As mentioned supra, the electrophotosensitive material of the invention comprises an intermediate layer and a photosensitive layer which are laminated on a conductive substrate in this order.

Intermediate Layer

The intermediate layer contains a thermosetting resin as a binder resin.

There may be used any of the various thermosetting resins conventionally used in the intermediate layer and the photosensitive layer. Specific examples of a usable thermosetting resin include silicone resin, epoxy resin, phenol resin, urea resin, melamine resin and other crosslinkable thermosetting resins. The phenol resin, in particular, is excellent in binding characteristic with the conductive substrate and resistance to dispersion medium and hence is most preferred.

The binder resin may employ another resin in combination with the thermosetting resin, so long as such a resin does not decrease the characteristics or productivity of the intermediate layer or the electrophotosensitive material.

Examples of the other usable resin than the thermosetting resin include thermoplastic resins such as styrene polymers, styrene-butadiene copolymer, styrene-acrylonitrile copolymer, styrene-maleic acid copolymer, acrylic polymers, styrene-acrylic acid copolymer, polyethylene, ethylene-vinyl acetate copolymer, chlorinated polyethylene, polyvinyl chloride, polypropyrene, ionomer, vinyl chloride-vinyl acetate copolymer, polyester, alkyd resin, maleic acid resin, polyamide, polyurethane, polycarbonate, polyallylate, polysulfone, diallyl phthalate resin, ketone resin, polyvinyl butyral resin, polyether resin; and photocurable resins such as epoxy-acrylate, urethane-acrylate and the like.

Out of the above resins, acrylic polymers, polyester, alkyd resin, maleic acid resin, polyamide, and polyurethane are preferably used. These resins forming a three dimensional network in the molecule and forming the intermediate layer with the thermosetting resin having insolubility in the dispersion medium contained in the coating solution for the photosensitive layer.

Considering the aforesaid characteristics of the intermediate layer, the amount of the other resin may preferably be in the range of not more than 40 parts by weight based on 100 parts by weight of thermosetting resin.

The intermediate layer may contain a pigment for the purposes of adjusting the conductivity thereof and preventing the occurrence of interference fringe.

Such a pigment includes known organic pigments and inorganic pigments.

Examples of a usable organic pigment include various types of phthalocyanine pigments, polycyclic quinone pigments, azo pigments, perylene pigments, indigo pigments, quinacridone pigments, azulenium salt pigments, squalirium pigments, cyanine pigments, pyrylium dyes, thiopyrylium dyes, xanthene dyes, quinoneime coloring matters, triphenylmethane coloring matters, styryl coloring matters, anthanthrone pigments, pylylium salt, triphenylmethane pigments, threne pigments, toluidine pigments, pyrazoline pigments and the like.

Examples of a usable inorganic pigment include metal oxides such as titanium oxide ($TiO_2$), tin oxide ($SnO_2$), aluminum oxide ($Al_2O_3$), zinc oxide (ZnO), indium-titanium oxide (ITO) and the like; and alkaline earth metal salts such as calcium carbonate ($CaCO_3$), barium carbonate ($BaCO_3$), barium sulfate ($BaSO_4$) and the like.

Furthermore, there may be used the above inorganic pigments doped with antimony oxide or the like, or the above inorganic pigment particles coated with tin oxide or indium oxide, so long as such materials are not extremely low in volume resistivity.

A variety of surface treatments are applicable to the above particles so long as the particles are not extremely reduced in volume resistivity. For instance, the particles may be coated with a metal oxide film such as of aluminum, silicon, zinc, nickel, antimony, chromium or the like.

As required, the particles may be treated with a coupling agent or a surface treatment agent, such as stearic acid, organic siloxane or the like, for increased dispersibility in the binder resin or coating solution and for impartation of water repellency.

The pigments may be used alone or in combination of two or more types. Above all, the metal oxides, or particularly titanium oxide, tin oxide and zinc oxide are preferred.

The mixing ratio of the pigment may preferably be in the range of 5 to 500 parts by weight or more preferably of 20 to 250 parts by weight based on 100 parts by weight of binder resin.

If the pigment is present in concentrations of less than 5 parts by weight, the mixing of the pigment may not provide a sufficient effect to adjust the conductivity of the intermediate layer and to prevent the occurrence of interference fringe.

If the pigment is present in concentrations of more than 500 parts by weight, the pigment is prone to produce particle agglomeration. The particle agglomeration causes the intermediate layer to suffer varied conductivities, although the intermediate layer, as a whole, is increased in conductivity. Specifically, an area of higher conductivity and an area of lower conductivity are distributed in the intermediate layer where the electric charge is prone to be trapped in the area of lower conductivity. Consequently, the photosensitive layer is increased in residual potential, resulting in the occurrence of fog or the like.

The intermediate layer may preferably have a thickness of 0.1 to 50 $\mu$m, or more preferably of 1 to 30 $\mu$m.

If the intermediate layer has a thickness of less than 0.1 $\mu$m, the intermediate layer may be unable to attain the aforesaid effect to cover up the defect in the surface of the conductive substrate for providing the defect-free, smooth surface of the photosensitive layer. If, on the other hand, the intermediate layer has a thickness in excess of 50 $\mu$m, the intermediate layer may be unable to contribute to a smooth removal of the charge of the photosensitive layer. This results in an increased residual potential of the photosensitive layer and a greater tendency of occurrence of fog.

Visible Absorption Spectrum

According to the invention, the ratio $A_2/A_1$ of the absorbances in the visible absorption spectrum of the intermediate layer is used as a yardstick for determining the curing degree of the thermosetting resin, as described above.

As a preparatory step, there must be previously found a correlation between the residual potential of the electrophotosensitive material and the absorbance in the visible absorption region of the intermediate layer. More specifically, intermediate-layer samples of various curing degrees are formed from a composition for actual use under varied heat treatment conditions, the composition containing a thermosetting resin. Each of the samples is determined for an absorbance $A_1$ at the first measurement wavelength $W_1$ in its visible absorption spectrum and for an absorbance $A_2$ at the second measurement wavelength $W_2$. Then, a photosensitive layer for actual use is laid over each of the intermediate-layer samples and the residual potential thereof is measured. Thus is obtained a correlation distribution between the absorbance ratio $A_2/A_1$ and the residual potential as to a given combination of the intermediate layer and photosensitive layer, as shown in FIG. 1 for example.

In this case, the first measurement wavelength $W_1$ may be an optional wavelength on the shorter-wave side of the maximum absorption wavelength in the visible absorption spectrum, whereas the second measurement wavelength $W_2$ may be an optional wavelength on the longer-wave side of the maximum absorption wavelength. It is noted that if a wavelength at which the absorbance varies most significantly according to changes of the heat treatment conditions is selected as either one of the measurement wavelengths, there is obtained a great range of the ratio $A_2/A_1$. This facilitates the definition of an optimum range of the absorbance ratio to be described hereinlater, resulting in an increased accuracy.

Figure 1:
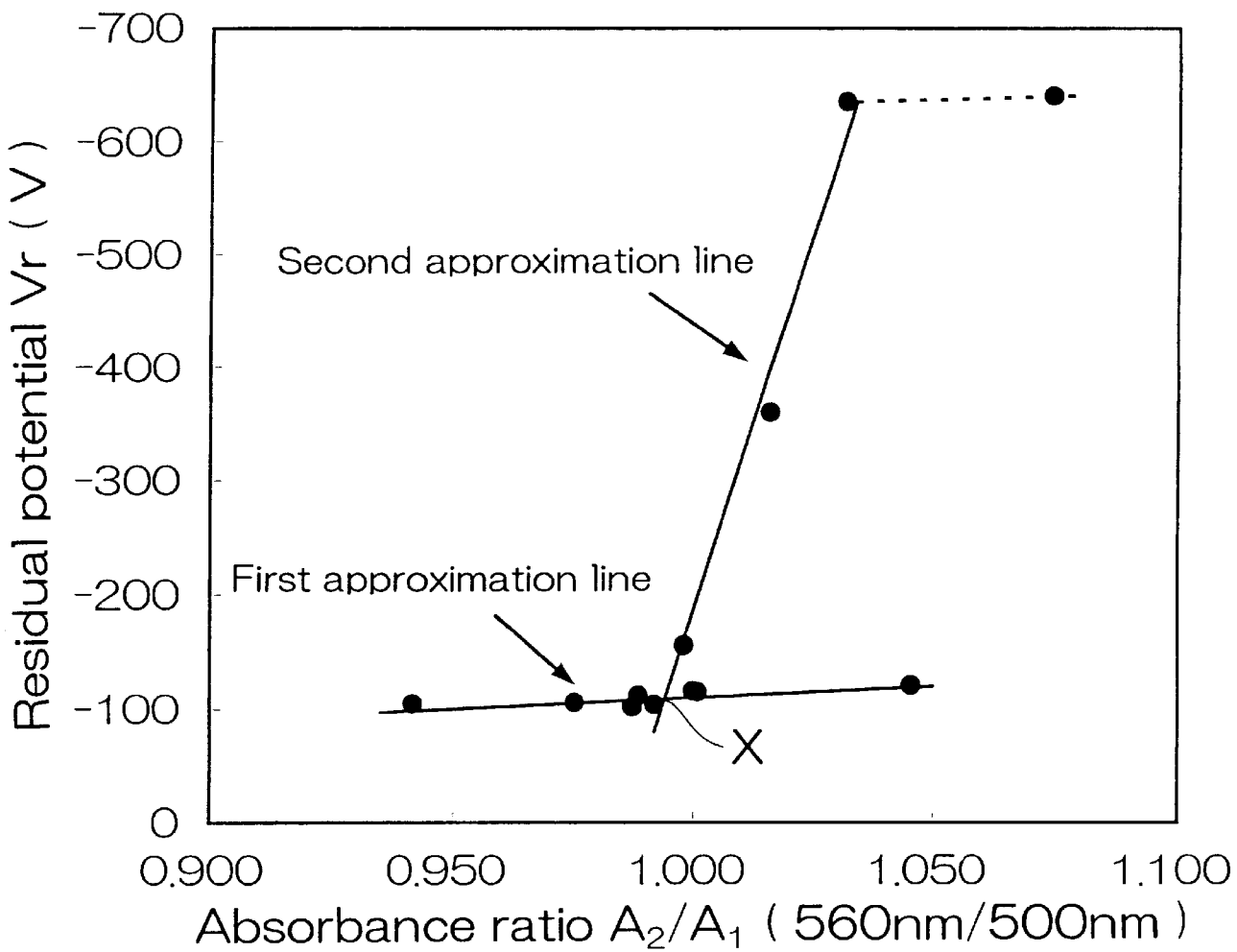
FIG. 1 is a graph showing a correlation distribution between a ratio $A_2/A_1$ and a residual potential of a electrophotosensitive material, $A_1$ denoting an absorbance at a first measurement wavelength (=500 nm) and $A_2$ denoting an absorbance at a second measurement wavelength (=560 nm) in a visible absorption spectrum of an intermediate layer of Example 1 of the invention.
Figure 2:
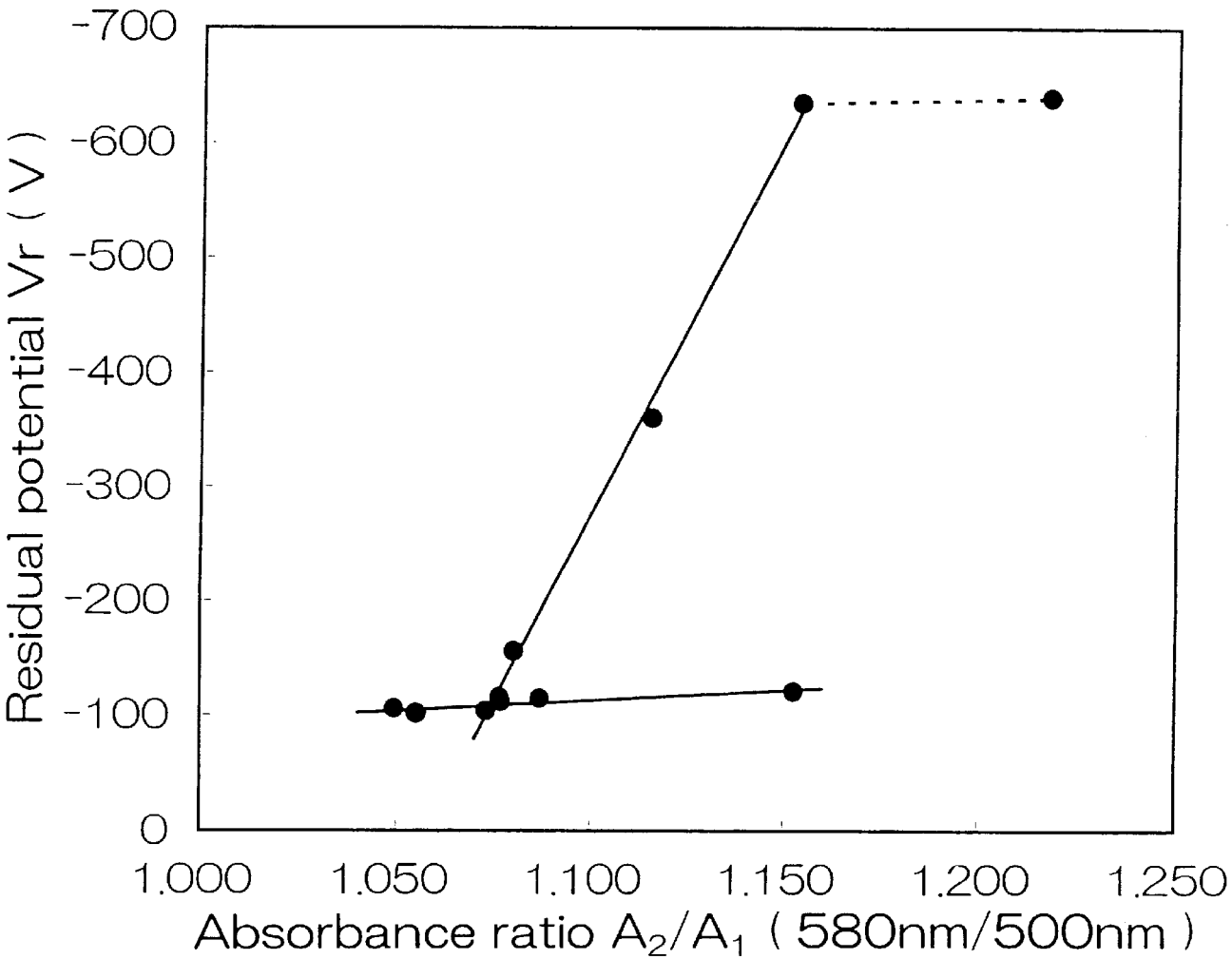
FIG. 2 is a graph showing a correlation distribution between a ratio $A_2/A_1$ and a residual potential of a electrophotosensitive material, $A_1$ denoting an absorbance at the first measurement wavelength (=500 nm) and $A_2$ denoting an absorbance at a second measurement wavelength (=580 nm) in a visible absorption spectrum of an intermediate layer of Example 1 of the invention.
Figure 3:
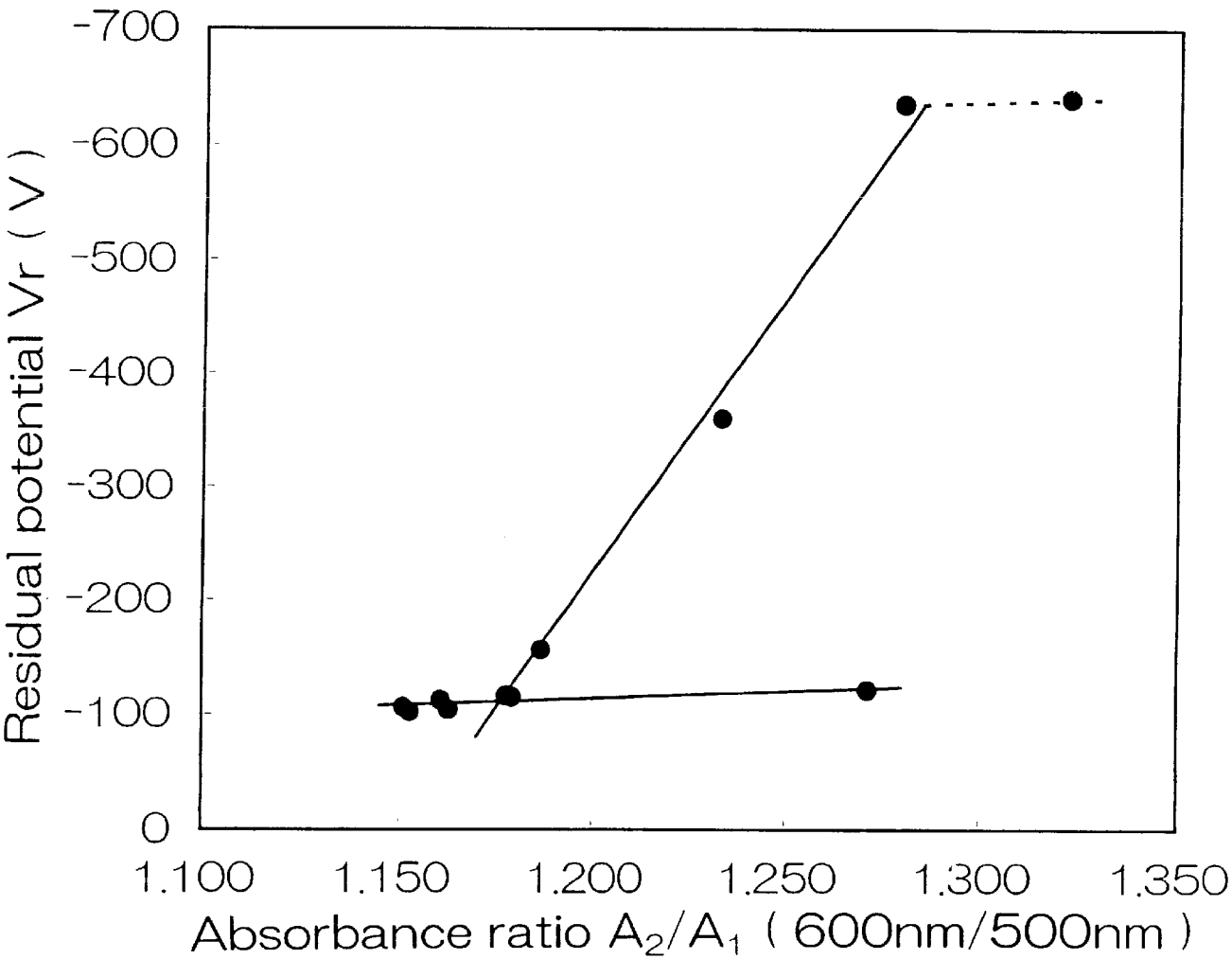
FIG. 3 is a graph showing a correlation distribution between a ratio $A_2/A_1$ and a residual potential of a electrophotosensitive material, $A_1$ denoting an absorbance at the first measurement wavelength (=500 nm) and $A_2$ denoting an absorbance at a second measurement wavelength (=600 nm) in a visible absorption spectrum of an intermediate layer of Example 1 of the invention.
Figure 4:
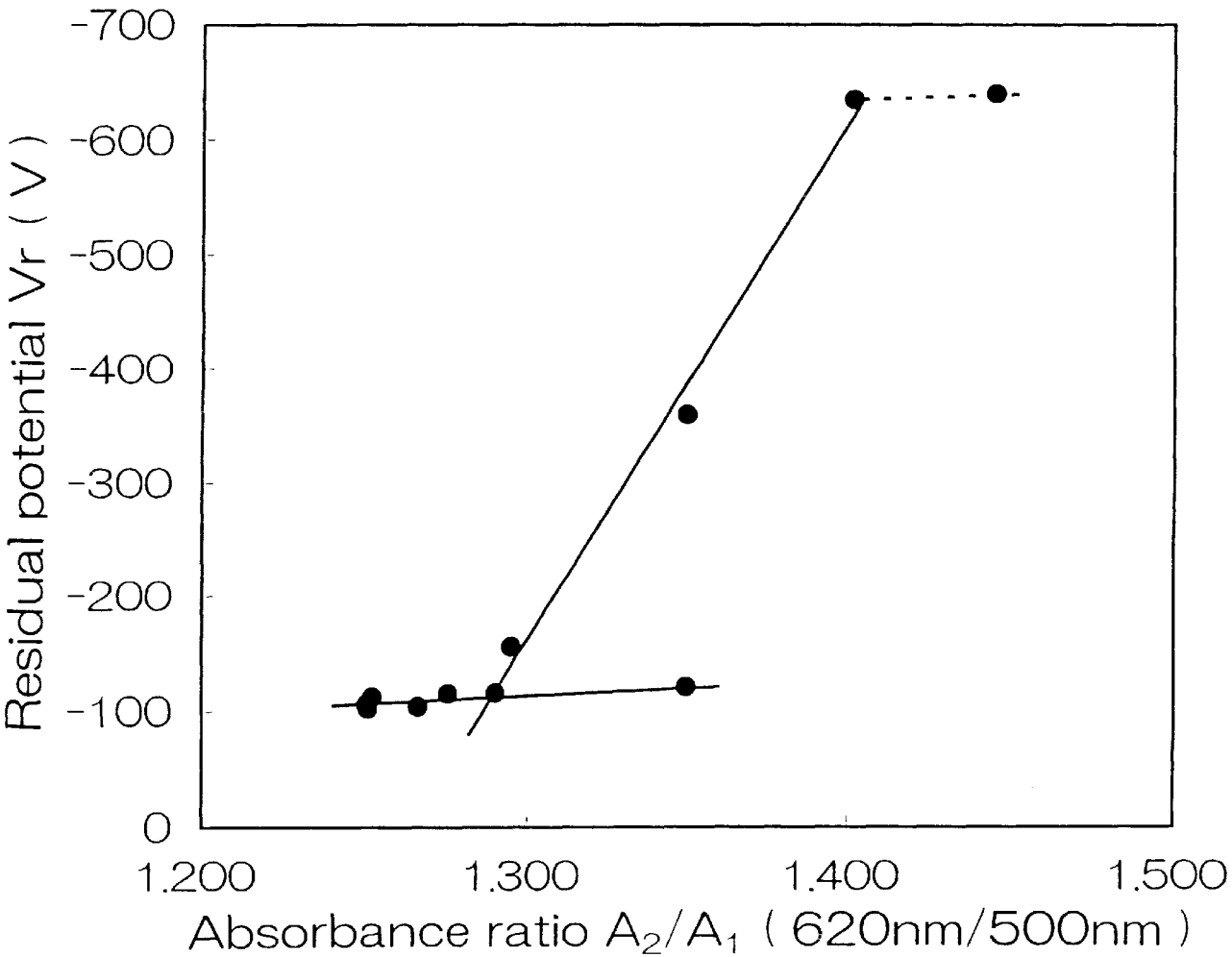
FIG. 4 is a graph showing a correlation distribution between a ratio $A_2/A_1$ and a residual potential of a electrophotosensitive material, $A_1$ denoting an absorbance at the first measurement wavelength (=500 nm) and $A_2$ denoting an absorbance at a second measurement wavelength (=620 nm) in a visible absorption spectrum of an intermediate layer of Example 1 of the invention.
Figure 5:
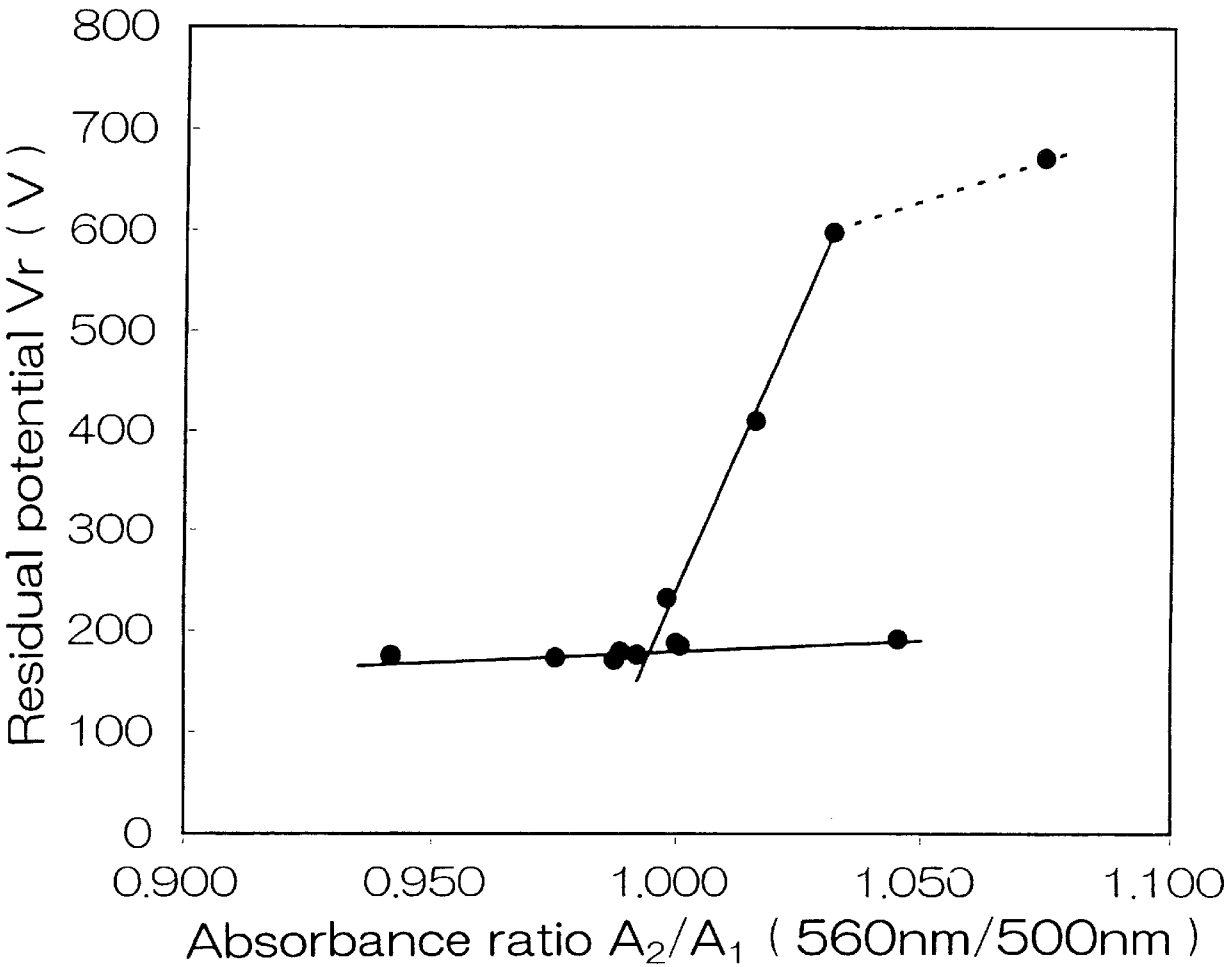
FIG. 5 is a graph showing a correlation distribution between a ratio $A_2/A_1$ and a residual potential of a electrophotosensitive material, $A_1$ denoting an absorbance at the first measurement wavelength (=500 nm) and $A_2$ denoting an absorbance at the second measurement wavelength (=560 nm) in a visible absorption spectrum of an intermediate layer of Example 2 of the invention.

FIG. 1 shows a correlation distribution between the absorbance ratio $A_2/A_1$ and the residual potential of an example of the invention, in which the first measurement wavelength $W_1$ is defined as 500 nm while the second measurement wavelength $W_2$ is defined as 560 nm.

Then, the correlation distribution is subjected to approximation by the least square method or the like thereby to find an approximation line representing a portion where the increase of the ratio $A_2/A_1$ involves little change of the residual potential (a first approximation line) and an approximation line representing a portion where the increase of the ratio $A_2/A_1$ involves an proportional increase of the residual potential (a second approximation line).

An optimum range of the absorbance ratio $A_2/A_1$ is determined from these approximation lines. Specifically, the optimum range of the absorbance ratio $A_2/A_1$ is defined to include values of not more than a value corresponding to an intersection X of the first approximation line and the second approximation line. Within this optimum range, the electrophotosensitive material presents stable low values of residual potential regardless of how the heat treatment was carried out.

It is noted in FIG. 1 that the plots for the ratios $A_2/A_1$ are present beyond the intersection X along the first approximation line. Such plots represent a sample heat treated at a relatively high temperature for not too short a treatment time (treatment temperature: 180° C., treatment time: 10–30 min.), and a sample heat treated at a low temperature for a long treatment time (treatment temperature: 150° C., treatment time: 30 min.), as shown in table 1. Such conditions are considered to be effective for sufficiently heat treating the intermediate layer.

However, a region exceeding the absorbance ratio $A_2/A_1$ for the intersection X also includes samples insufficiently heat treated and leading to higher residual potentials. That is, the samples belonging to this region involve great variations of the residual potential depending upon the heat treatment conditions and hence, an allowable range for the heat treatment conditions is narrow. In addition, the resultant electrophotosensitive materials are prone to suffer quality variations.

Therefore, the intermediate layers belonging to the region exceeding the absorbance ratio $A_2/A_1$ for the intersection X are precluded.

The absorbance can be measured using a commercially available spectrophotometer or spectrophotometric calorimeter. Needless to say, the measurement for determining the above correlation must be performed under the same conditions (field of view, type of light source, color coordinate system and the like) as those in the actual production of the electrophotosensitive material.

For determination of the correlation between the residual potential and the absorbance, a plural number of samples may be prepared using the same materials as those for producing the electrophotosensitive material and varying the heat treatment conditions for forming the intermediate layer.

The heat treatment conditions include the heat treatment temperature and the heat treatment time. The samples of various curing degrees may be prepared under varied heat treatment temperatures and times.

Conductive Substrate

The conductive substrate may employ any of those formed from various materials having conductivity. Examples of a usable conductive substrate include those formed from metals such as iron, aluminum, copper, tin, platinum, silver, vanadium, molybdenum, chromium, cadmium, titanium, nickel, palladium, indium, stainless steel, brass and the like; that formed from a plastic material on which any of the above metals is deposited or laminated; and a glass substrate coated with aluminum iodide, tin oxide, indium oxide or the like.

In short, the substrate itself may have the conductivity or the surface thereof may have the conductivity. It is preferred that the conductive substrate has a sufficient mechanical strength in use.

The conductive substrate may have any form, such as sheet, drum and the like, according to the construction of the image forming apparatus to which the conductive substrate is applied.

A surface of the conductive substrate may be subjected to a surface treatment such as roughening treatment, oxidizing treatment, etching and the like.

Photosensitive Layer

The photosensitive layer is classified into a single-layer type and a multi-layer type according to the composition thereof. The single-layer electrophotosensitive material comprises a single photosensitive layer laid over an intermediate layer, the photosensitive layer at least containing a charge transport material, charge generating material and binder resin. The multi-layer electrophotosensitive material comprises a charge generating layer containing a charge generating material, and a charge transport layer containing a charge transport material, the charge generating layer and charge transport layer laminated on the intermediate layer in this order or vise versa. The specific compositions of the photosensitive layers of the single-layer and multi-layer electrophotosensitive materials, the specific examples of the charge generating material and charge transport material and the mixing ratio thereof, the forming method of the photosensitive layer, the examples of an additive which may be contained additionally to the binder resin, charge generating material and charge transport material, and the examples of a layer which may be formed additionally to the photosensitive layer may be those conventionally known to the art.

Such details are stated in, for example, Japanese Laid-open Patent Publication Nos. JP10-26836A (1998), JP11-102081A (1999), JP11-344813A (1999), JP11-352710A (1999), JP2000-3049A (2000), JP2000-3051A (2000), JP2000-10324A (2000), JP2000-56488A (2000), and JP2000-75510A (2000); and U.S. Pat. Nos. 5,753,395; 5,932,384; 5,932,722; 5,942,362; 5,955,230; 5,958,638; 6,015,646; 6,045,957; 6,120,955 and the like.

Production Method and Inspection Method for Electrophotosensitive Material

A production method and an inspection method for the electrophotosensitive material of the invention will be described.

Formation of Intermediate Layer

In a case where the intermediate layer is formed by a coating method, a coating solution is prepared by mixing and dispersing the aforesaid binder resin and pigment, as required, together with a suitable dispersion medium by means of known means such as a roll mill, ball mill, attritor, paint shaker, ultrasonic disperser and the like.

The coating solution is applied to the surface of the conductive substrate by any of the known coating methods including dipping, blade coating, spraying and the like. The resultant coating film is heat treated for curing the thermosetting resin and thus is formed the intermediate layer.

Any of the various known organic solvents may be used as the dispersion medium.

Examples of a usable organic solvent include alcohols such as methanol, ethanol, isopropanol, butanol and the like;

- aliphatic hydrocarbons such as n-hexane, octane, cyclohexane and the like;
- aromatic hydrocarbons such as benzene, toluene, xylene and the like;
- halogenated hydrocarbons such as dichloromethane, dichloroethane, carbon tetrachloride, chlorobenzene and the like;
- ethers such as dimethyl ether, diethyl ether, tetrahydrofuran, 1,4-dioxane, ethyleneglycol dimethyl ether, diethyleneglycol dimethyl ether and the like;
- ketones such as acetone, methyl ethyl ketone, cyclohexanone and the like;
- esters such as ethyl acetate, methyl acetate and the like; and
- dimethylformaldehyde, dimethylformamide, dimethyl sulfoxide and the like. These solvents may be used alone or in combination of two or more types.

The coating solution may further contain a surfactant, leveling agent or the like for increasing the dispersibility of the pigment, and for enhancing the surface smoothness of the intermediate layer.

According to a first production method of the invention, when an absorbance ratio $A_2/A_1$ in a visible absorption spectrum of an intermediate layer so formed is not more than a previously determined value corresponding to the intersection of the first approximation line and the second approximation line in the correlation distribution between the ratio and the residual potential of the electrophotosensitive material, the photosensitive layer is laid over this intermediate layer.

According to a second production method of the invention, before the intermediate layer is formed in the aforementioned manner, the heat treatment conditions that provide a ratio $A_2/A_1$ of a value not more than the value corresponding to the intersection of the first approximation line and the second approximation line are determined from the above correlation distribution. The thermosetting resin is cured under the heat treatment conditions thus determined, thereby to form the intermediate layer.

As to the heat treatment conditions according to these production methods, it is preferred for increased productivity to define the heat treatment conditions by selecting the easiest possible condition that provides the optimum range of the absorbance ratio. In other words, either a lower treatment temperature or a shorter treatment time may preferably be selected. Of the heat treatment conditions, increasing the treatment temperature is more effective to increase the curing degree than increasing the treatment time.

According to an inspection method of the invention, an intermediary is classified into an acceptable one in which an aborbance ratio $A_2/A_1$ in a visible absorption spectrum of an intermediate layer so formed is not more than the value corresponding to the intersection of the first approximation line and the second approximation line in the correlation distribution, and a defective one in which an absorbance ratio exceeds the value corresponding to the intersection.

Formation of Photosensitive Layer

The formation of the intermediate layer is followed by overlaying a photosensitive layer thereon. Similarly to the intermediate layer, the photosensitive layer may be formed by the known coating method, such as those stated in the aforesaid publications.

EXAMPLES

The invention will hereinbelow be described by way of reference to examples.

Example 1

Preparation of Intermediary

The following procedure was taken to prepare an intermediary of a electrophotosensitive material, in which an intermediate layer was formed on a conductive substrate and before forming the photosensitive layer on the intermediate layer.

Formation of Intermediate Layer

The following ingredients along with zirconia beads having a size of 1 mm were mixed and dispersed by a ball mill operated for 24 hours thereby to prepare a coating solution for intermediate layer.

Binder resin: 60 parts by weight of phenol resin (TD447 available from Dainippon Ink & Chemicals Inc.)

Pigment: 100 parts by weight of titanium oxide (TA-300 available from Fuji Titanium Industry Co.,Ltd.)

Dispersion medium: 100 parts by weight of methanol, and 10 parts by weight of diacetone alcohol The resultant coating solution was applied to an outer periphery of an aluminum tube having a diameter of 30 mm by way of a Teflon blade and then was heat treated under heat treatment conditions listed in Table 1. Thus was formed an intermediate layer having a thickness of 10 $\mu$m.

Visible Absorption Spectrum Measurement

A spectrophotometric calorimeter (CM-1000R available from Minolta Co., Ltd. ) was used to measure the visible absorption spectrum of each intermediate layer of the above intermediary. Then, a maximum absorption wavelength (nm) and absorbances $A_1$, $A_2$ at the first measurement wavelength $W_1$ and at the second measurement wavelength $W_2$ with respect to the maximum absorption wavelength were determined from the measurement results. Incidentally, the first measurement wavelength $W_1$ was defined as 500 nm whereas the second measurement wavelength $W_2$ was defined as 560 nm, 580 nm, 600 nm or 620 nm. The measurement conditions are listed as below:

Unit of the graph: Absorbance

Type of indication: Spectral characteristics

Measurement field of view: Two degrees

Type of light source: D65

Color coordinate system: Yxy

Measurement atmosphere: 20±2° C., 60±2% RH

The results are listed in Table 1.

TABLE 1

| Treatment conditions | | Maximum absorption wavelength (nm) | Absorbance | | | | |
|---|---|---|---|---|---|---|---|
| | | | $W_1$ (nm) | $W_2$(nm) | | | |
| Time (min.) | Temperature (° C.) | | 500 nm | 560 nm | 580 nm | 600 nm | 620 nm |
| 5 | 150 | 518 | 0.956 | 1.027 | 1.164 | 1.264 | 1.382 |
| 10 | 150 | 525 | 1.040 | 1.073 | 1.200 | 1.331 | 1.458 |
| 15 | 150 | 525 | 1.054 | 1.071 | 1.176 | 1.300 | 1.423 |
| 30 | 150 | 525 | 1.080 | 1.129 | 1.245 | 1.373 | 1.458 |
| 5 | 180 | 525 | 1.060 | 1.058 | 1.145 | 1.258 | 1.373 |
| 10 | 180 | 528 | 1.085 | 1.085 | 1.168 | 1.278 | 1.400 |
| 15 | 180 | 530 | 1.104 | 1.105 | 1.200 | 1.302 | 1.408 |
| 30 | 180 | 535 | 1.131 | 1.118 | 1.218 | 1.313 | 1.416 |
| 5 | 200 | 530 | 1.091 | 1.064 | 1.145 | 1.256 | 1.364 |
| 10 | 200 | 535 | 1.105 | 1.091 | 1.166 | 1.274 | 1.382 |
| 15 | 200 | 530 | 1.123 | 1.114 | 1.205 | 1.306 | 1.422 |
| 30 | 200 | 540 | 1.236 | 1.164 | 1.227 | 1.302 | 1.391 |

From the results of Table 1, there was determined the ratio $A_2/A_1$ between the absorbance $A_1$ at the first measurement wavelength $W_1$ (=500nm) and the absorbance $A_2$ at the second measurement wavelength $W_2$ (=560 nm, 580 nm, 600 nm or 620 nm). The results are listed in Table 2.

TABLE 2

| Treatment conditions | | Absorbance ratio $A_2/A_1$ | | | |
|---|---|---|---|---|---|
| Time (min) | Temperature (° C.) | 560 nm/ 500 nm | 580 nm/ 500 nm | 600 nm/ 500 nm | 620 nm/ 500 nm |
| 5 | 150 | 1.074 | 1.218 | 1.322 | 1.446 |
| 10 | 150 | 1.032 | 1.154 | 1.280 | 1.402 |
| 15 | 150 | 1.016 | 1.116 | 1.233 | 1.350 |
| 30 | 150 | 1.045 | 1.153 | 1.271 | 1.350 |
| 5 | 180 | 0.998 | 1.080 | 1.187 | 1.295 |
| 10 | 180 | 1.000 | 1.076 | 1.178 | 1.290 |
| 15 | 180 | 1.001 | 1.087 | 1.179 | 1.275 |
| 30 | 180 | 0.989 | 1.077 | 1.161 | 1.252 |
| 5 | 200 | 0.975 | 1.049 | 1.151 | 1.250 |
| 10 | 200 | 0.987 | 1.055 | 1.153 | 1.251 |
| 15 | 200 | 0.992 | 1.073 | 1.163 | 1.266 |
| 30 | 200 | 0.942 | 0.993 | 1.053 | 1.125 |

Formation of Multi-layer Photosensitive Layer

Subsequent to the visible absorption spectrum measurement, a multi-layer photosensitive layer was formed on the intermediate layer of each intermediary as follows thereby to obtain an electrophotosensitive material.

Formation of Charge Generating Layer

The following two ingredients were dispersed using an ultrasonic disperser:

Pigment: 1 part by weight of Y-type titanyl phthalocyanine

Dispersion medium: 39 parts by weight of ethyl cellosolve

The resultant dispersion was admixed with a solution containing the following two ingredients and was further dispersed by the ultrasonic disperser. Thus was prepared a coating solution for charge generating layer:

Binder resin: 1 part by weight of polyvinylbutyral (BM-1 available from Sekisui Chemical Co., Ltd.)

Dispersion medium: 9 parts by weight of ethyl cellosolve

The resultant coating solution was applied to the intermediate layer of each intermediary by way of a Teflon blade. The coating film was dried and solidified by heating at 110° C. for 5 minutes thereby to form a charge generating layer having a thickness of 0.5 $\mu$m.

Formation of Charge Transport Layer

A coating solution for charge transport layer was prepared by mixing and dispersing the following ingredients:

Electron transport material: 0.05 parts by weight of 3,3',5,5'-tetra-tert-butyl-4,4'-diphenoquinone Hole transport material: 0.8 parts by weight of N,N,N',N'-tetrakis(3-methylphenyl)1,3-diaminobenzene Binder resin: 0.95 parts by weight of Z-type polycarbonate (Panlite TS2050 available from Teijin Chemicals Ltd.) and 0.05 parts by weight of polyester resin (RV200 available from TOYOBO CO., LTD.)

Dispersion medium: 8 parts by weight of tetrahydrofuran

The resultant coating solution was applied to the charge generating layer by way of a Teflon blade. The coating film was dried and solidified by heating at 110° C. for 30 minutes thereby to form a charge transport layer having a thickness of 30 $\mu$m.

In this manner, the multi-layer photosensitive layer was laid over the intermediate layer thereby to obtain the electrophotosensitive material.

Measurement of Residual Potential

Each of the electrophotosensitive materials thus produced was charged at −700±20V using a drum sensitivity tester available from GENTEC Co.

A bandpass filter was used to extract monochromatic light from white light from a halogen lamp as a light source of the tester. The surface of the above electrophotosensitive material was irradiated with the extracted monochromatic light (half-width: 20 nm, light intensity I=16 $\mu$W/cm$^2$) having a wavelength of 780 nm (irradiation time: 80 msec). Then, the residual potential Vr(V) of each electrophotosensitive material was determined by measuring a surface potential thereof after the lapse of 330 seconds from the start of the irradiation.

The results are listed in Table 3.

TABLE 3

| Treatment conditions | | Residual |
|---|---|---|
| Time (min) | Temperature (° C.) | potential Vr(V) |
| 5 | 150 | −640 |
| 10 | 150 | −635 |
| 15 | 150 | −360 |
| 30 | 150 | −121 |
| 5 | 180 | −156 |
| 10 | 180 | −116 |
| 15 | 180 | −115 |
| 30 | 180 | −112 |
| 5 | 200 | −106 |
| 10 | 200 | −102 |
| 15 | 200 | −104 |
| 30 | 200 | −105 |

The results listed in Tables 2 and 3 were used to prepare FIGS. 1 to 4, in which the residual potential Vr(V) was plotted on the ordinate and the absorbance ratio $A_2/A_1$ on the abscissa and in which the first approximation line and the second approximation line were drawn. As seen in the figures, a region representing the greatest absorbance ratio $A_2/A_1$ includes a portion representing a minor variation of residual potential Vr(V) (as indicated by the dot line). This portion is thought to indicate that the residual potential Vr(V) has approached an upper limit because the initial surface potential is set to −700±20V.

The absorbance ratio $A_2/A_1$ and the residual potential Vr(V) in correspondence to the intersection X of the first approximation line and the second approximation line were found from each of FIGS. 1 to 4. The results are listed in Table 4.

TABLE 4

| | | 560 nm/ 500 nm | 580 nm/ 500 nm | 600 nm/ 500 nm | 620 nm/ 500 nm |
|---|---|---|---|---|---|
| X | $A_2/A_1$ | 0.994 | 1.074 | 1.176 | 1.290 |
| | Vr (V) | −111 | −111 | −113 | −114 |

Table 4 and FIGS. 1 to 4 indicates that in the actual production of the electrophotosensitive material of the above composition, the heat treatment conditions may be so defined as to provide the absorbance ratio $A_2/A_1$ in the optimum range of not more than any of the above values. It was found that the electrophotosensitive materials having the absorbance ratio within the optimum range have stable residual potentials Vr(V) on the order of about −110V regardless of the heat treatment conditions but that the electrophotosensitive materials having the absorbance ratio beyond the optimum range are significantly varied in the residual potential Vr(V) depending upon the heat treatment conditions. Table 1 indicates that the heat treatment conditions providing the absorbance ratio in the optimum range are any one of the conditions of 30 min. at 180° C.; 5 min. at 200° C.; 10 min. at 200° C.; 15 min. at 200° C.; and 30 min. at 200° C.

Particularly, the conditions of 5 min. at 200° C.; 10 min. at 200° C.; 15 min. at 200° C.; and 30 min. at 200° C. are more preferred because the absorbance ratios $A_2/A_1$ for all the four second absorption wavelengths $W_2$ are within the optimum range.

Forming the intermediate layer under any of the above heat treatment conditions ensures that the resultant electrophotosensitive materials are notably reduced in the variations of residual potential Vr(V) from lot to lot.

Example 2

Formation of Single-layer Photosensitive Layer

The following procedure was taken to form a single-layer photosensitive layer on the same intermediate layer of the intermediary as in Example 1, thereby producing an electrophotosensitive material.

The following ingredients were mixed and dispersed by a ball mill operated for 50 hours thereby to prepare a coating solution for single-layer photosensitive layer.

Charge generating material: 5 parts by weight of X-type metal-free phthalocyanine Binder resin: 95 parts by weight of Z-type polycarbonate (Panlite TS2050 available from Teijin Chemicals Ltd.) and 5 parts by weight of polyester resin (RV200 available from TOYOBO CO., LTD.)

Hole transport material: 60 parts by weight of 3,3'-dimethyl-N,N,N',N'-tetrakis(4-methylphenyl)-1,1'-biphenyl-4,4'-diamine Electron transport material: 50 parts by weight of 3,5-dimethyl-3',5'-di-tert-butyl-4,4'-diphenoquinone Dispersion medium: 800 parts by weight of tetrahydrofuran The resultant coating solution was applied to the intermediate layer of each intermediary by way of a Teflon blade. The coating film was dried and solidified by heating at 100° C. for 1 hour thereby to form the single-layer photosensitive layer having a thickness of 20 $\mu$m.

In this manner, the single-layer photosensitive layer was laid over the intermediate layer to obtain the electrophotosensitive material.

Measurement of Residual Potential

Each of the electrophotosensitive materials thus produced was charged at +700±20V using a drum sensitivity tester available from GENTEC Co.

A bandpass filter was used to extract monochromatic light from white light from a halogen lamp as a light source of the tester. The surface of the above electrophotosensitive material was irradiated with the extracted monochromatic light (half-width: 20 nm, light intensity I=16 $\mu$W/cm$^2$) having a wavelength of 780 nm (irradiation time: 80 msec). Then, the residual potential Vr(V) of each electrophotosensitive material was determined by measuring a surface potential thereof after the lapse of 330 seconds from the start of the irradiation.

The results are listed in Table 5.

TABLE 5

| Treatment conditions | | Residual |
|---|---|---|
| Time (min) | Temperature (° C.) | potential Vr(V) |
| 5 | 150 | 672 |
| 10 | 150 | 598 |
| 15 | 150 | 410 |
| 30 | 150 | 192 |

TABLE 5-continued

| Treatment conditions | | Residual |
|---|---|---|
| Time (min) | Temperature (° C.) | potential Vr(V) |
| 5 | 180 | 232 |
| 10 | 180 | 188 |
| 15 | 180 | 185 |
| 30 | 180 | 179 |
| 5 | 200 | 173 |
| 10 | 200 | 171 |
| 15 | 200 | 176 |
| 30 | 200 | 175 |

The results listed in Tables 2 and 5 were used to prepare FIGS. 5 to 8, in which the residual potential Vr(V) was plotted on the ordinate and the absorbance ratio $A_2/A_1$ on the abscissa and in which the first approximation line and the second approximation line were drawn. As seen in the figures, a region representing the greatest absorbance ratio $A_2/A_1$ includes a portion representing a minor variation of residual potential Vr(V) (as indicated by the dot line). This portion is thought to indicate that the residual potential Vr(V) has approached the upper limit because the initial surface potential is set to +700±20V.

The absorabance ratio $A_2/A_1$ and the residual potential Vr(V) in correspondence to the intersection of the first approximation line and the second approximation line were found from each of FIGS. 5 to 8. The results are listed in Table 6.

TABLE 6

| | | 560 nm/ 500 nm | 580 nm/ 500 nm | 600 nm/ 500 nm | 620 nm/ 500 nm |
|---|---|---|---|---|---|
| X | $A_2/A_1$ | 0.994 | 1.074 | 1.176 | 1.290 |
| | Vr (V) | 179 | 179 | 180 | 183 |

Table 6 and FIGS. 5 to 8 indicates that in the actual production of the electrophotosensitive material of the above composition, the heat treatment conditions may be so defined as to provide the absorbance ratio $A_2/A_1$ in the optimum range of not more than any of the above values. It was found that the electrophotosensitive materials having the absorbance ratio within the optimum range have stable residual potentials Vr(V) on the order of about +180V regardless of the heat treatment conditions but that the electrophotosensitive materials having the absorbance ratio beyond the optimum range are significantly varied in the residual potentials Vr(V) depending upon the heat treatment conditions. Table 1 indicates that the heat treatment conditions providing the absorbance ratio in the optimum range are any one of the conditions of 30 min. at 180° C.; 5 min. at 200° C.; 10 min. at 200° C.; 15 min. at 200° C.; and 30 min. at 200° C.

Particularly, the conditions of 5 min. at 200° C.; 10 min. at 200° C.; 15 min. at 200° C.; and 30 min. at 200° C. are more preferred because the absorbance ratios $A_2/A_1$ for all the four second absorption wavelengths $W_2$ are within the optimum range.

Forming the intermediate layer under any of the above heat treatment conditions ensures that the resultant electrophotosensitive materials are notably reduced in the variations of residual potential Vr(V) from lot to lot.

What is claimed is:

1. A production method for an electrophotosensitive material comprising a conductive substrate, an intermediate layer containing a thermosetting resin, and a photosensitive layer, the intermediate layer being laminated on the conductive substrate and the photosensitive layer being laminated on the intermediate layer, comprising the steps of:

previously deriving a correlation distribution between a ratio $A_2/A_1$ of absorbance $A_1$ measured at a first measurement wavelength $W_1$ which is a predetermined wavelength on a shorter-wave side of a maximum absorption wavelength in a visible absorption spectrum of the intermediate layer to absorbance $A_2$ measured at a second measurement wavelength $W_2$ which is a predetermined wavelength on a longer-wave side of the maximum adsorption wavelength and a residual potential of the photosensitive material from a plurality of heat treatment conditions for curing the thermosetting resin during the formation of the intermediate layer;

forming the intermediate layer containing the thermosetting resin on the conductive substrate; and overlaying the photosensitive layer selectively on the formed intermediate layer when the ratio $A_2/A_1$ determined from a visible absorption spectrum of the intermediate layer is not more than the value corresponding to an intersection of a first approximation line representative of a portion where an increase of the ratio $A_2/A_1$ involves relatively little change in the residual potential and a second approximation line representative of a portion where the increase of the ratio $A_2/A_1$ involves a proportional increase of the residual potential in the correlation distribution.

2. A production method for an electrophotosensitive material comprising a conductive substrate, an intermediate layer containing a thermosetting resin, and a photosensitive layer, the intermediate layer being laminated on the conductive substrate and the photosensitive layer being laminated on the intermediate layer, comprising the steps of:

previously deriving a correlation distribution between a ratio $A_2/A_1$ of absorbance $A_1$ measured at a first measurement wavelength $W_1$ which is a predetermined wavelength on a shorter-wave side of a maximum absorption wavelength in a visible absorption spectrum of the intermediate layer to absorbance $A_2$ measured at a second measurement wavelength $W_2$ which is a predetermined wavelength on a longer-wave side of the maximum adsorption wavelength and a residual potential of the photosensitive material from a plurality of heat treatment conditions for curing the thermosetting resin during the formation of the intermediate layer;

determining from the correlation distribution the heat treatment conditions that provide the ratio $A_2/A_1$ of not more than a value corresponding to an intersection of a first approximation line representative of a portion where an increase of the ratio $A_2/A_1$ involves relatively little change in the residual potential and a second approximation line representative of a portion where the increase of the ratio $A_2/A_1$ involves a proportional increase of the residual potential;

forming the intermediate layer by curing the thermosetting resin under the heat treatment conditions thus determined; and overlaying the photosensitive layer on the intermediate layer.

3. A method of inspecting an intermediary before forming a photosensitive layer on an intermediate layer of an electrophotosensitive material comprising a conductive substrate, an intermediate layer containing a thermosetting resin, and a photosensitive layer, the intermediate layer being laminated on the conductive substrate and the photosensitive layer being laminated on the intermediate layer, comprising the steps of:

previously deriving a correlation distribution between a ratio $A_2/A_1$ of absorbance $A_1$ measured at a first measurement wavelength $W_1$ which is a predetermined wavelength on a shorter-wave side of a maximum absorption wavelength in a visible absorption spectrum of the intermediate layer to absorbance $A_2$ measured at a second measurement wavelength $W_2$ which is a predetermined wavelength on a longer-wave side of the maximum adsorption wavelength and a residual potential of the photosensitive material from a plurality of heat treatment conditions for curing the thermosetting resin during the formation of the intermediate layer;

measuring the visible absorption spectrum of the intermediate layer; and classifying the intermediary into an acceptable one in which the ratio $A_2/A_1$ is not more than a value corresponding to an intersection of a first approximation line representative of a portion where an increase of the ratio $A_2/A_1$ involves relatively little change in the residual potential and a second approximation line representative of a portion where the increase of the ratio $A_2/A_1$ involves a proportional increase of the residual potential, and a defective one in which the ratio $A_2/A_1$ is more than the value corresponding to the intersection.

* * * * *